US011105113B2

(12) United States Patent
Shires et al.

(10) Patent No.: US 11,105,113 B2
(45) Date of Patent: Aug. 31, 2021

(54) HALF-PYRAMID SHELTER WITH IMPROVED STABILITY, ACCESS AND ROOM

(71) Applicant: Tarptent, Inc., Nevada City, CA (US)

(72) Inventors: Henry Shires, Nevada City, CA (US); Erica Dombro, Nevada City, CA (US)

(73) Assignee: Tarptent, Inc., Nevada City, CA (US)

( * ) Notice: Subject to any disclaimer, the term of this patent is extended or adjusted under 35 U.S.C. 154(b) by 0 days.

(21) Appl. No.: 16/693,713

(22) Filed: Nov. 25, 2019

(65) Prior Publication Data

US 2020/0165835 A1 May 28, 2020

Related U.S. Application Data

(60) Provisional application No. 62/771,821, filed on Nov. 27, 2018.

(51) Int. Cl.

| | |
|---|---|
| ***E04H 15/26*** | (2006.01) |
| ***E04H 15/62*** | (2006.01) |
| ***E04H 15/54*** | (2006.01) |

(52) U.S. Cl.

CPC ..... *E04H 15/26* (2013.01); *E04H 15/54* (2013.01); *E04H 15/62* (2013.01)

(58) Field of Classification Search

CPC ..... E04H 15/24; E04H 15/26; E04H 15/28
See application file for complete search history.

(56) References Cited

U.S. PATENT DOCUMENTS

| | | | | |
|---|---|---|---|---|
| 1,531,473 A * | 3/1925 | Barbour | E04H 15/26 135/99 |
| 2,567,697 A | 9/1951 | Craighead, Jr. et al. | |
| 2,865,385 A * | 12/1958 | Crafts | E04H 15/42 135/156 |
| 7,406,977 B1 | 8/2008 | Shires | |
| 7,673,642 B1 | 3/2010 | Shires | |
| 7,841,356 B2 | 11/2010 | Shires | |
| 8,555,910 B2 * | 10/2013 | Webster | E04H 15/04 135/156 |

(Continued)

FOREIGN PATENT DOCUMENTS

| | | | | |
|---|---|---|---|---|
| GB | 193597 A * | 3/1923 | E04H 15/26 |

OTHER PUBLICATIONS

Willis Wall; Plexamid: Zpacks Newest Solo Single Pole Tent; Willis Wall Celebrate the Outdoors (internet blog); May 11, 2018; Willis Wall Multimedia; 12 pages; U.S.

(Continued)

*Primary Examiner* — David R Dunn
*Assistant Examiner* — Danielle Jackson
(74) *Attorney, Agent, or Firm* — Northern Michigan Patent Law, PLC

(57) ABSTRACT

A half-pyramid backpacking type fabric shelter with sufficient stability to omit a front guyline and remain standing when the front entrance is open, and with improved headroom and useable floor space. The peak of the shelter canopy at the front entrance is supported by a vertical pole, and includes short forward and rear canopy ridgelines whose ends are located below the peak to receive the tips of a horizontal cross-strut crossing the vertical pole below the peak. The rear corners of the shelter canopy are preferably raised and structured by a triangular strut structure.

12 Claims, 9 Drawing Sheets

(56) References Cited

U.S. PATENT DOCUMENTS

| | | | | |
|---|---|---|---|---|
| 8,684,020 | B1 | 4/2014 | Shires | |
| 10,760,297 | B2 * | 9/2020 | Shin | E04H 15/26 |

OTHER PUBLICATIONS

Actonetakeone; Beach Tent Shade; www.actonetakeone.com (internet advertisement); Aug. 15, 2018; 3 pages; Actonetakeone; U.S.
Guangzhou Pedestrian UL Gear Store; T-door Design Strut Corner; AliExpress.com internet advertisement; Aug. 15, 2018; 3 pages; www.AliExpress.com; U.S.
Station13Thirteen; Ultralight 1 Person Tent; eBay internet advertisement; Aug. 6, 2018; 4 pages; www.ebay.co.uk; U.S.
Philip Werner; Ultralight Backpacking Pyramid Tent and Tarp Primer; Section Hikers Backpacking Blog; Aug. 15, 2018; 7 pages; www.sectionhiker.com; U.S.

* cited by examiner

HALF-PYRAMID SHELTER WITH IMPROVED STABILITY, ACCESS AND ROOM

RELATED APPLICATIONS/PRIORITY BENEFIT CLAIM

This application claims the benefit of U.S. Provisional Application No. 62/771,821, filed Nov. 27, 2018 by the same inventors (Shires and Dombro), the entirety of which provisional application is hereby incorporated by reference.

FIELD

The subject matter of the present application is in the field of lightweight tarp and tent shelters used by backpackers.

BACKGROUND

Backpackers typically look for a combination of stability, light weight, ease of access, and usable space in a tarp or tent shelter (hereafter "shelter"). Experienced backpackers, and especially ultralight backpackers, often make the weight of the shelter the deciding factor. Providing a suitable balance among these attributes is difficult given the limitations of what can be carried in a backpack.

One class of tarp or tent shelters is the half-pyramid, in which a lightweight canopy, for example made from lightweight coated or siliconized nylon fabric, is supported at its peak at the open front of the shelter with a single vertical pole, stick, trekking pole, kayak paddle shaft, or similar (hereafter "pole"). The half-pyramid shelter is reasonably stable when well-staked, lightweight, roomy at the center or peak height, and open and airy at the front. However, the half-pyramid suffers from the disadvantages of 1) a lack of room along the staked-down lower edges and corners, reducing the effective useful footprint for sleeping, cooking, and storing gear; 2) a lack of stability unless the staked rear corners are counter-balanced by at least one strong forward guyline staked out in front of the entrance; and, 3) a reduction in ease of access at the front entrance due to the guyline(s).

BRIEF SUMMARY

The present invention is a lightweight, one-pole, half-pyramid type backpacking shelter with improved stability, front access, and interior room.

The shelter comprises a canopy having side walls narrowing upwardly at a converging angle to define a pole-supported peak with a short ridgeline extending rearwardly and downwardly from the peak to a rear cross-strut support point. A rear wall is joined to the rear edges of the side walls and terminates at its upper end at the rear cross-strut support point. Shorter front eave walls extend from the front edges of the sidewalls to define a front entrance opening, with wider upper ends extending forwardly and downwardly from the peak to define a forward ridgeline terminating at a front strut support point, the eaves narrowing inwardly from the front strut support toward the lower front corners of the side walls. A horizontal cross-strut located adjacent but below the peak extends forwardly and rearwardly in a direction substantially perpendicular to the front entrance, the ends of the cross-strut engaging the front and rear strut support points at the ends of the forward and rear ridgelines. The cross-strut crosses an upper end of a vertical pole supporting the peak at a location below the peak.

In a further form, the upper ends of the front edges of the side walls converge at the peak, while the lower front corners of the side walls extend forwardly beyond the plane of the vertical pole and the peak.

The side walls and the rear wall may be joined at each rear corner of the shelter by a triangular strut structure.

In a further form, the lower edges and front corners of the side walls may be pivoted or raised upwardly in tension by increasing the vertical support pole height relative to the rear corners, such that the lower edges of the side walls are angled upwardly from the rear corners when the rear corners are staked down.

In a further form, the forward strut support point defines a forward maximum of the canopy beyond the lower front corners, while the lower ends of the eave walls terminate at the lower front corners of the side walls rearwardly of the forward maximum.

Terms of orientation and shape such as "vertical", "horizontal", "perpendicular", "triangular", and others should generally be understood herein to mean substantially or essentially so, rather than exactly. For example, the unstructured nature of the canopy fabric and variations in terrain and individual shelter set-up can affect the orientation and shape of the shelter and its components relative to one another and the ground.

These and other features and advantages of the invention will become apparent from the detailed description below, in light of the accompanying drawings.

DETAILED DESCRIPTION

Figure 1:
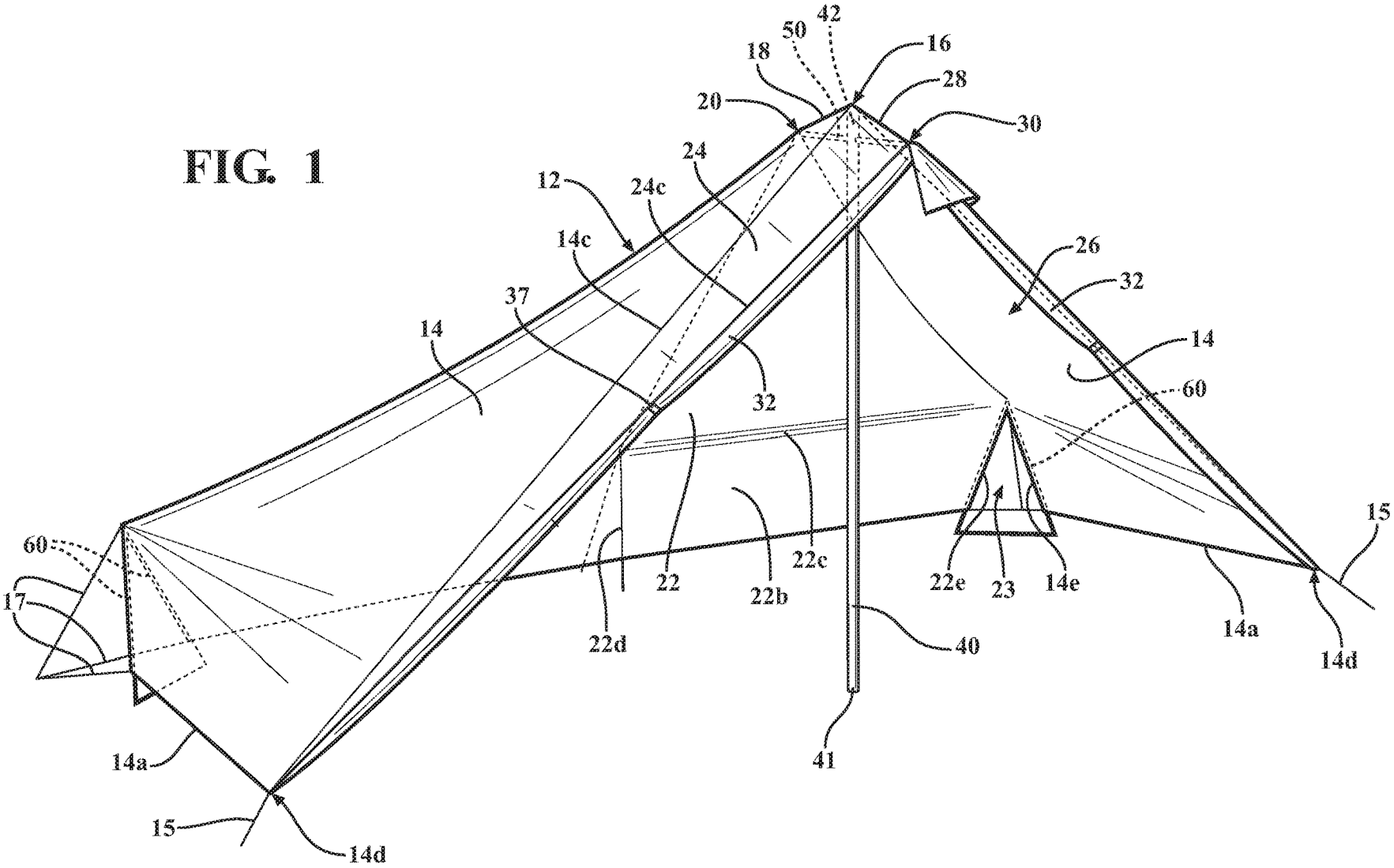
FIG. 1 is a front perspective view of a shelter according to the present invention, with the front entrance open.

FIG. 1 shows a fabric backpacker's shelter 10 in exemplary form in order to teach how to make and use the claimed invention. Shelter 10 comprises a weather-resistant fabric canopy 12, for example made from commercially available ultra-light waterproof fabric, preferably a non-stretch or low-stretch fabric such as Dyneema® Composite fabric, although other fabrics are known and suitable for such use in tents and tarps and come in a variety of fabric weights, coatings, and materials. The use of a non-stretch or low-stretch fabric such as Dyneema® Composite fabric or other substantially non-stretch equivalent helps to maintain static equilibrium of forces on the shelter's pole and strut structure via fabric tension.

Figure 7:
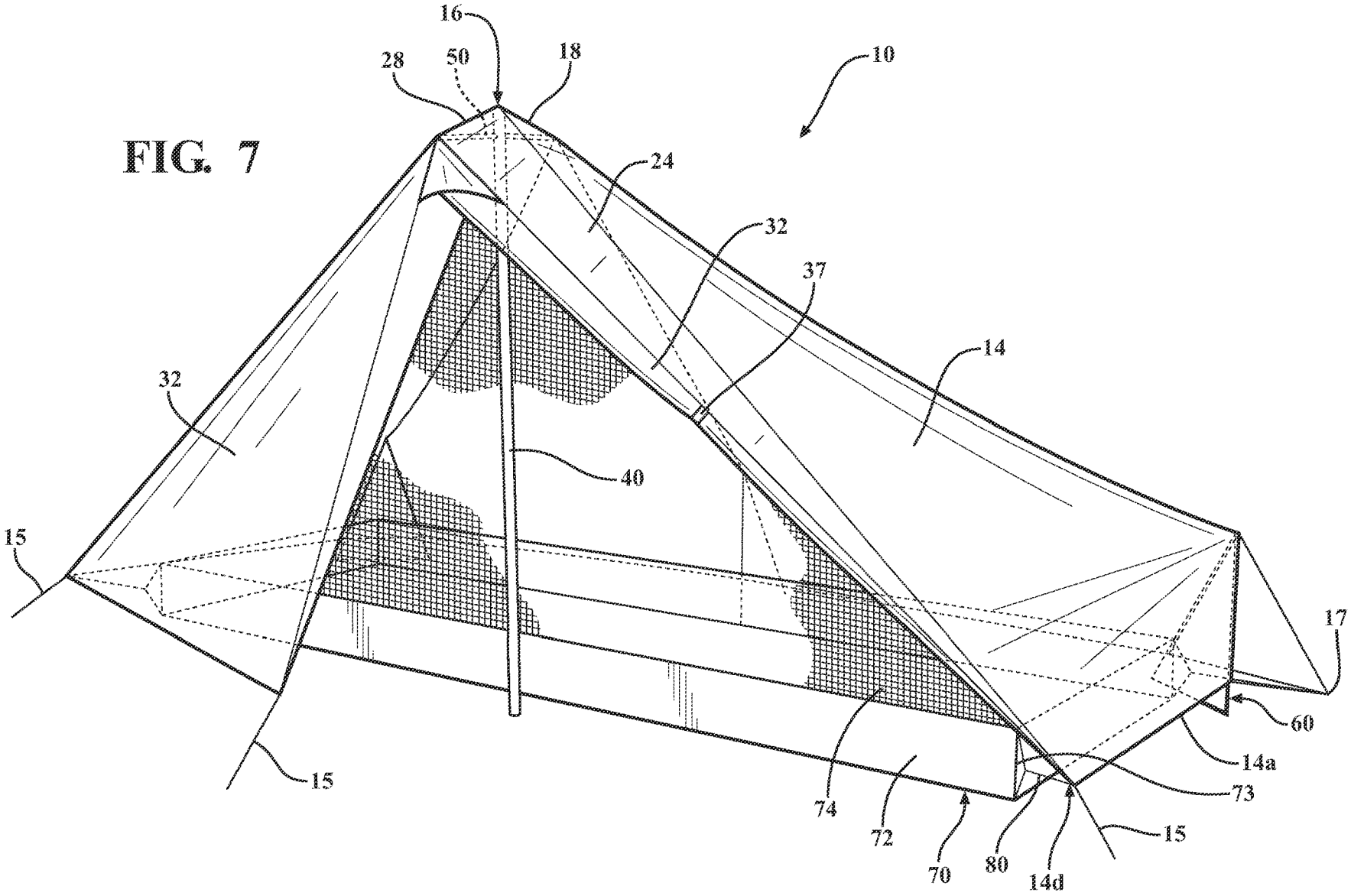
FIG. 7 is a front perspective view of the shelter of FIG. 1, viewed from an opposing angle relative to FIG. 1, with the entrance partially open and an inner tent body included beneath the canopy.

The shelter in FIG. 1 is shown in a basic floorless form, meaning a weatherproof canopy or "fly" supported by pole and strut structure with no attached inner floor or inner tent structure. Such additional inner features may be added as desired, and one option is shown in FIG. 7 below.

Figure 2:
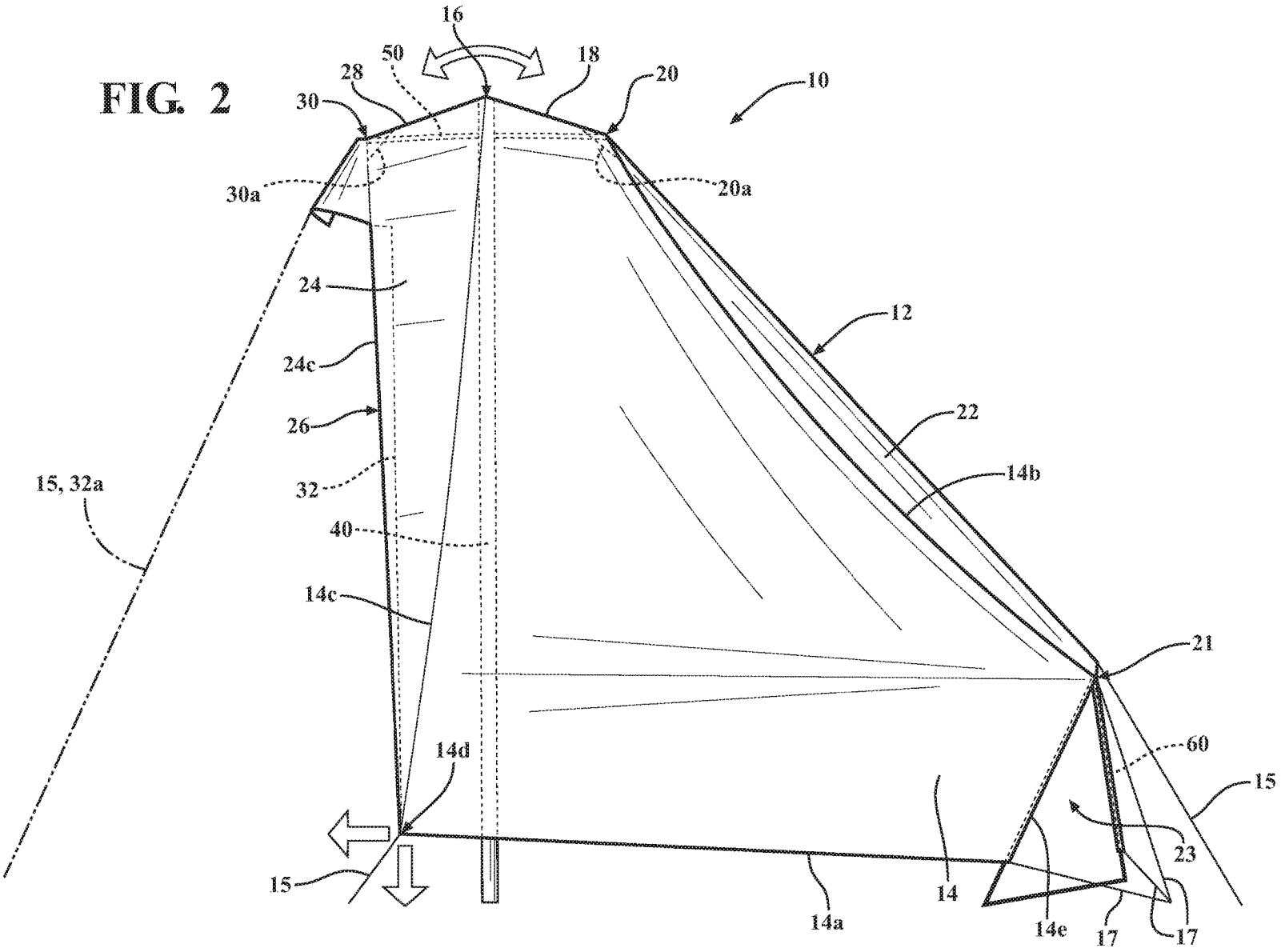
FIG. 2 is a side elevation view of the shelter of FIG. 1.

Referring to FIGS. 1 and 2, canopy 12 comprises a pair of side walls 14, with wider lower edges 14*a* narrowing upwardly toward their junction, e.g. a sewn seam, which defines a canopy peak 16, a rear ridgeline 18, and a rear cross-strut support point 20. Side walls 14 are further connected by a rear wall 22 joined to side wall rear edges 14*b*.

Figure 3:
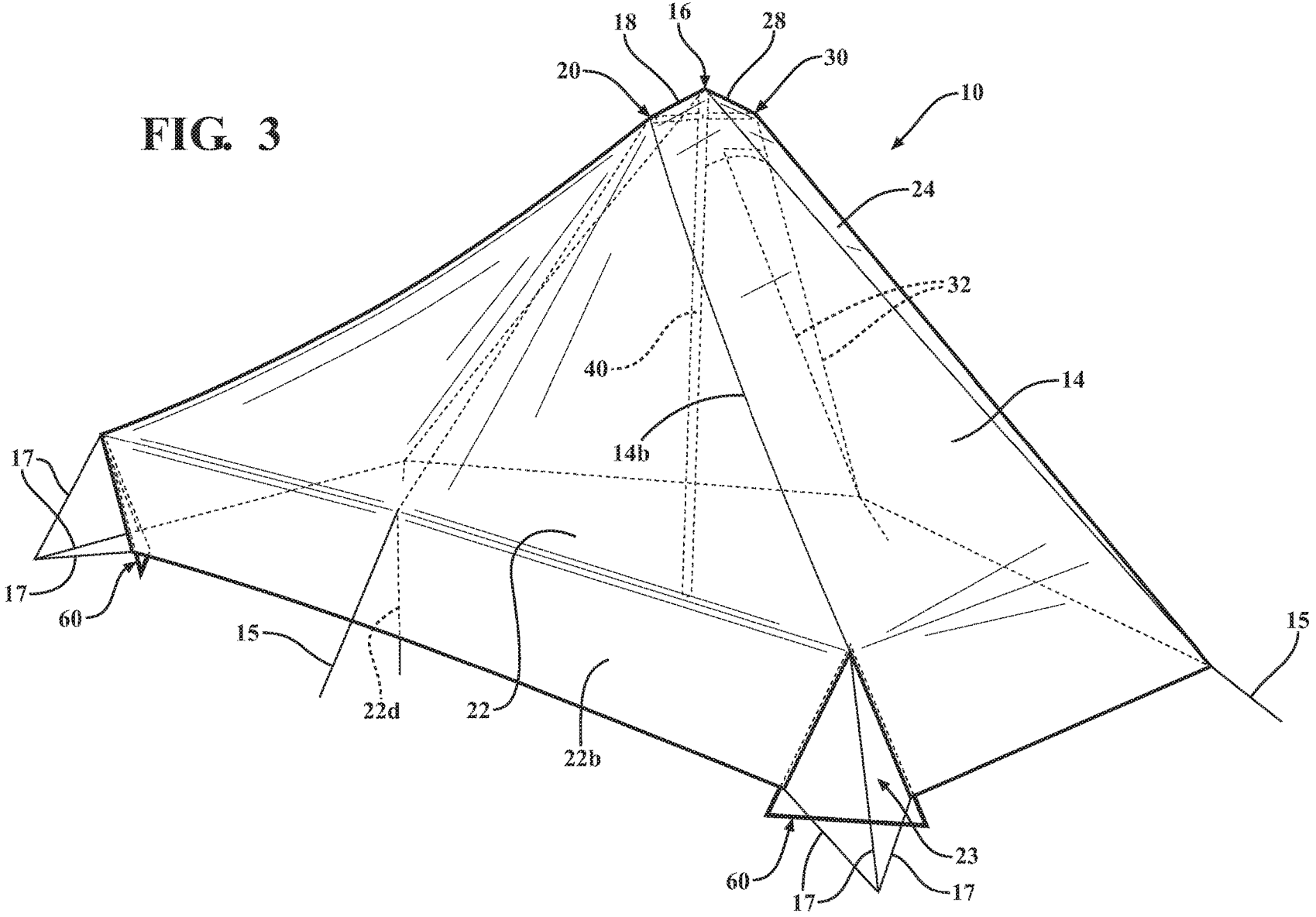
FIG. 3 is a rear perspective view of the shelter of FIG. 1.
Figure 6:
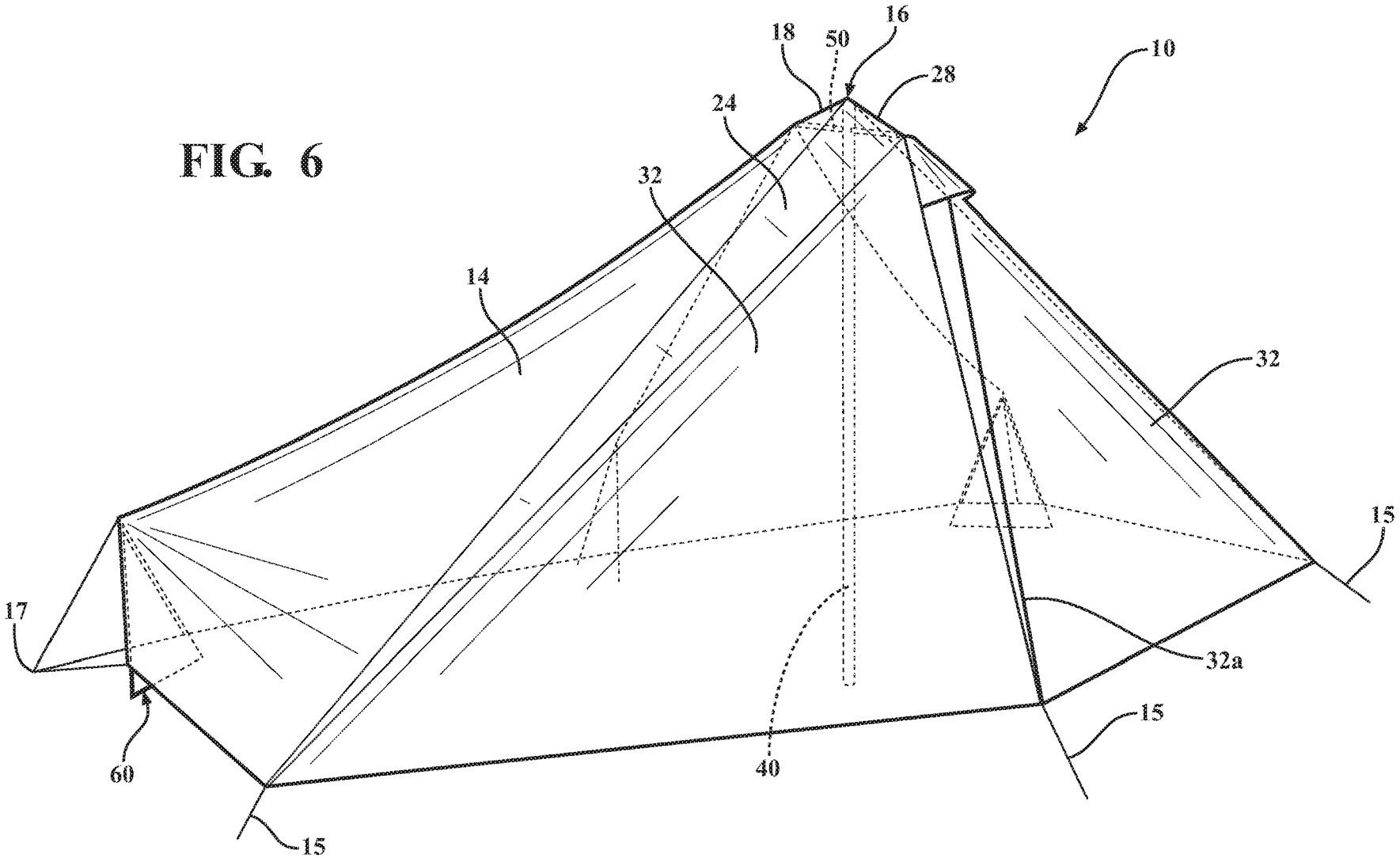
FIG. 6 is a front perspective view of the shelter of FIG. 1, with the front entrance closed.

Canopy 12 further comprises front eave walls 24 joined to and extending forwardly from the front edges 14*c* of side walls 14, again for example along a sewn seam. Eave walls 24 may terminate at their front edges 24*c* for a simplified open-fronted shelter, or they may have front door panels 32 attached to the front edges 24*c* or forming an integral extension of the eave walls 24, in FIG. 2 shown rolled up against the front edges 24*c* of the eave walls 24 in hidden lines, but capable of being unfastened and extended out and downwardly to the ground at an angle forwardly of the front cross-strut support as shown in FIGS. 3, 6 and 7. In either case, the front edges 24*c* of eave walls 24 define a substantially triangular front opening or shelter entrance 26 and a line of tension from a front cross-strut support point 30 at the forward end of a cross-strut 50 at the top of the shelter. Eave walls 24 are wider at their upper ends where they join to define a forward canopy ridgeline 28 extending downwardly and forwardly of peak 16. Forward canopy ridgeline 28 extends from peak 16 to a maximum forward point defining the front cross-strut support point 30. Any front door panels 32 may be attached to front edges 24*c* by a seam or may be an integral extension of the eave walls 24 with the line of tension along 24*c* generally denoting the line along which the door panels 32 are rolled up and stored when the front of the shelter is open.

Rear wall 22 preferably includes a short vertical lower section 22*b* offset from the angled remainder of rear wall 22 when the canopy is erected. Lower vertical section 22*b* may for example be defined by a seam 22*c*, or by a bias in the cut of the fabric. The short vertical section 22*b* of rear wall 22 may further be shaped when the shelter is set up by one or more simple vertical struts 22*d* secured to the fabric in known manner and optionally guyed out rearwardly of the shelter.

Canopy 12 is primarily supported by a removable vertical pole 40 with a lower end 41 resting on the ground and an upper end or tip 42 placed against the inside of peak 16. For this purpose peak 16 may be reinforced internally with a patch or pocket of heavier puncture-resistant fabric or similar pliable material, a grommet or small plastic cup, or some other equivalent pole receiving structure (see FIG. 8 at 16*a*). Backpackers are known to use trekking poles, sticks, and paddle shafts for use as improvised vertical tarp shelter supports, but shelter 10 may have a dedicated vertical support pole supplied with the canopy 12 as shown schematically at 40 in FIGS. 1-7. Front and rear cross-strut support points 30 and 20 may be similarly reinforced, as shown for example at 20*a* and 30*a* in FIGS. 2 and 8, with reinforced pouches or pockets or grommets to receive the ends of a cross-strut and hold them in place under tension from the canopy fabric.

Figure 8:
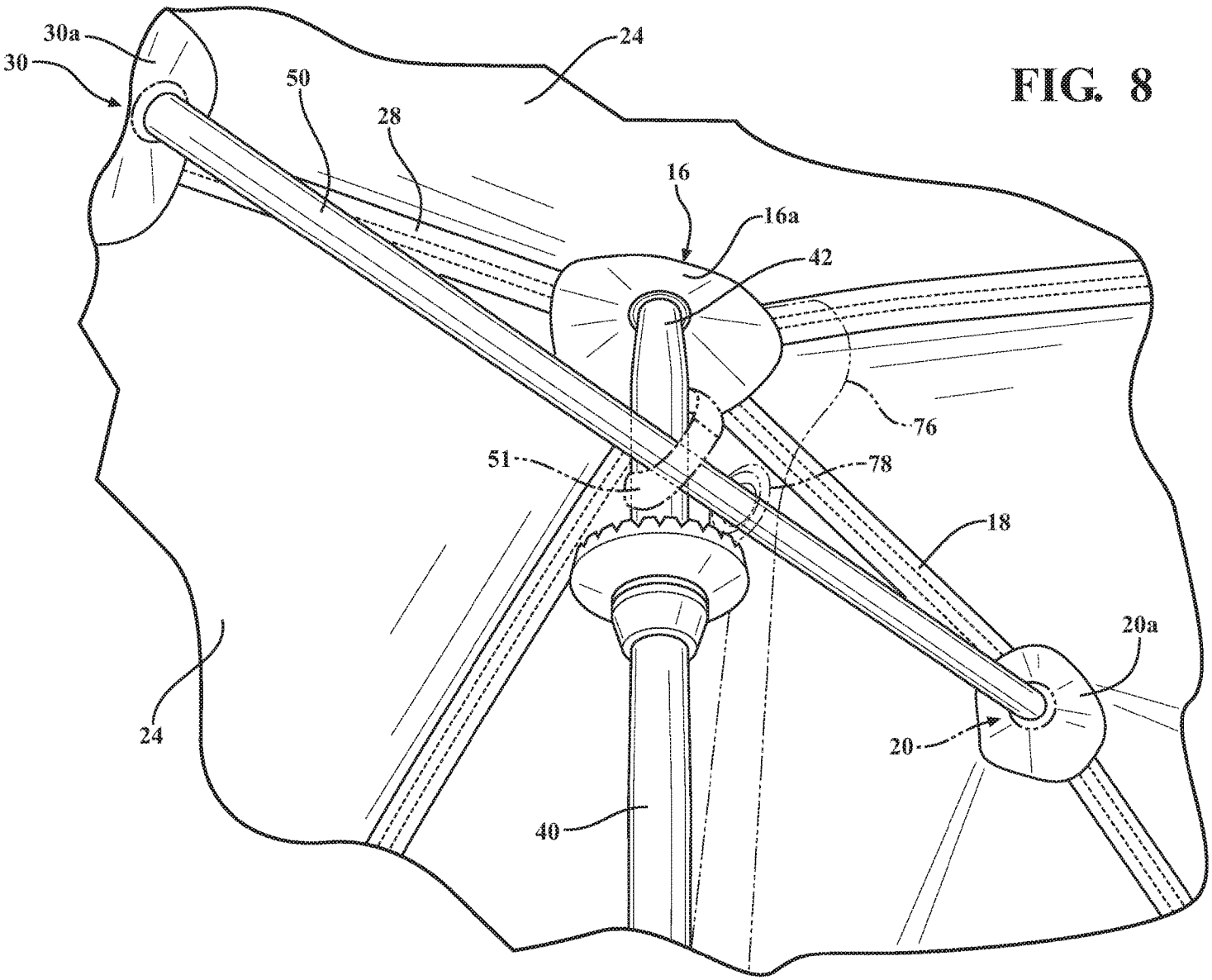
FIG. 8 is a detail view of the interior of the shelter of FIG. 1 near the peak, showing the relationship between the peak, the vertical support pole, and the cross-strut.

Canopy 12 is further structured and supported off the ground by a short horizontal cross-strut 50, the cross-strut spaced below peak 16 and extending between front and rear cross-strut support points 30, 20 to one side of the upper end of vertical pole 40 (FIG. 8) in a direction generally perpendicular to front entrance 26 and at an angle generally perpendicular to pole 40. The cross-strut 50 is preferably evenly bisected by support pole 40 with substantially equal length portions of the cross-strut extending forwardly and rearwardly of the pole 40, and forward and rear canopy ridgelines 28, 18 are of equal length, so that the fabric-directed tension forces exerted on cross-strut 50 by the canopy fabric adjacent peak 16 at cross-strut support points 20 and 30 (and by any intermediate structure connecting the cross-strut to the fabric, such as shown in FIG. 8) are equally balanced. The result is cross-strut 50 being held securely between the cross-strut support points 20, 30 in upward tension by the force exerted by the vertical support pole on peak 16 through the canopy fabric to the cross-strut support points 20, 30, such that the cross-strut resists both rotation about the vertical support pole and lateral translation back and forth due to wind pressure on the front or back walls. As best shown in FIGS. 2 and 8, the horizontal spacing of the cross-strut support points 20, 30 is approximately equal to the length of cross-strut 50 to help hold the cross-strut 50 in position under fabric tension without the need for a connection between the cross-strut 50 and vertical pole 40. The cross-strut 50 may be removably held between the cross-strut support points 20, 30, for example with known pole-securing structure such as 20*a*, 30*a* as shown in FIG. 8, or the ends of the cross-strut 50 may be permanently secured in the cross-strut support points 20, 30.

The lower corners of the canopy 12 need to be staked to the ground in tension against the pole and cross-strut structure 40, 50 in order to erect the shelter. In the illustrated example, front corners 14*d* are staked in tension to the ground, either directly to the ground or (preferred) indirectly through a short guyline 15 attached to the corner fabric in known manner at one end and to a stake (not shown, but known) driven into the ground at the other end.

Figure 3A:
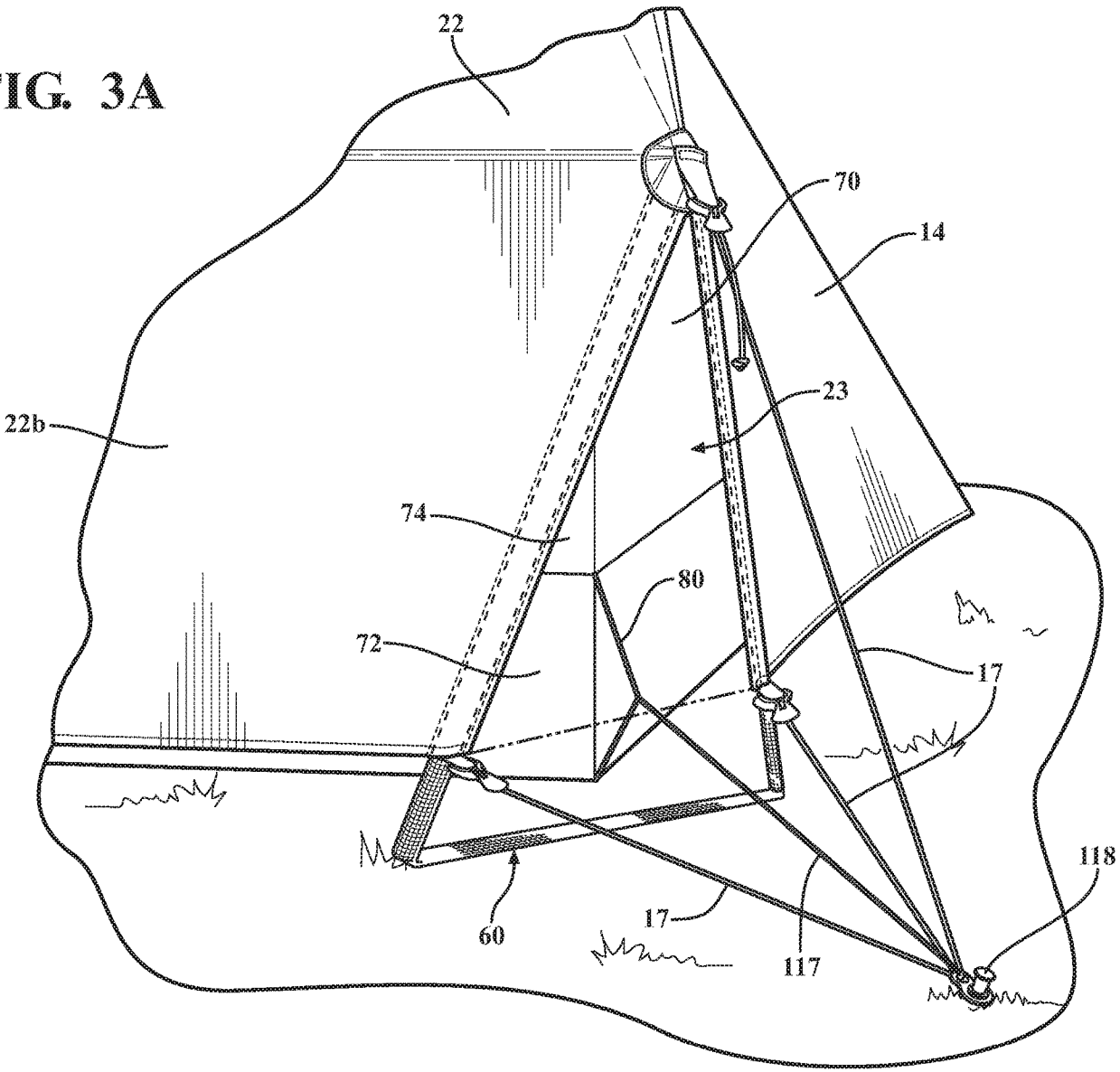
FIG. 3A is a detail perspective view of one of the rear corners and strut structure of the shelter of FIG. 1.
Figure 4:
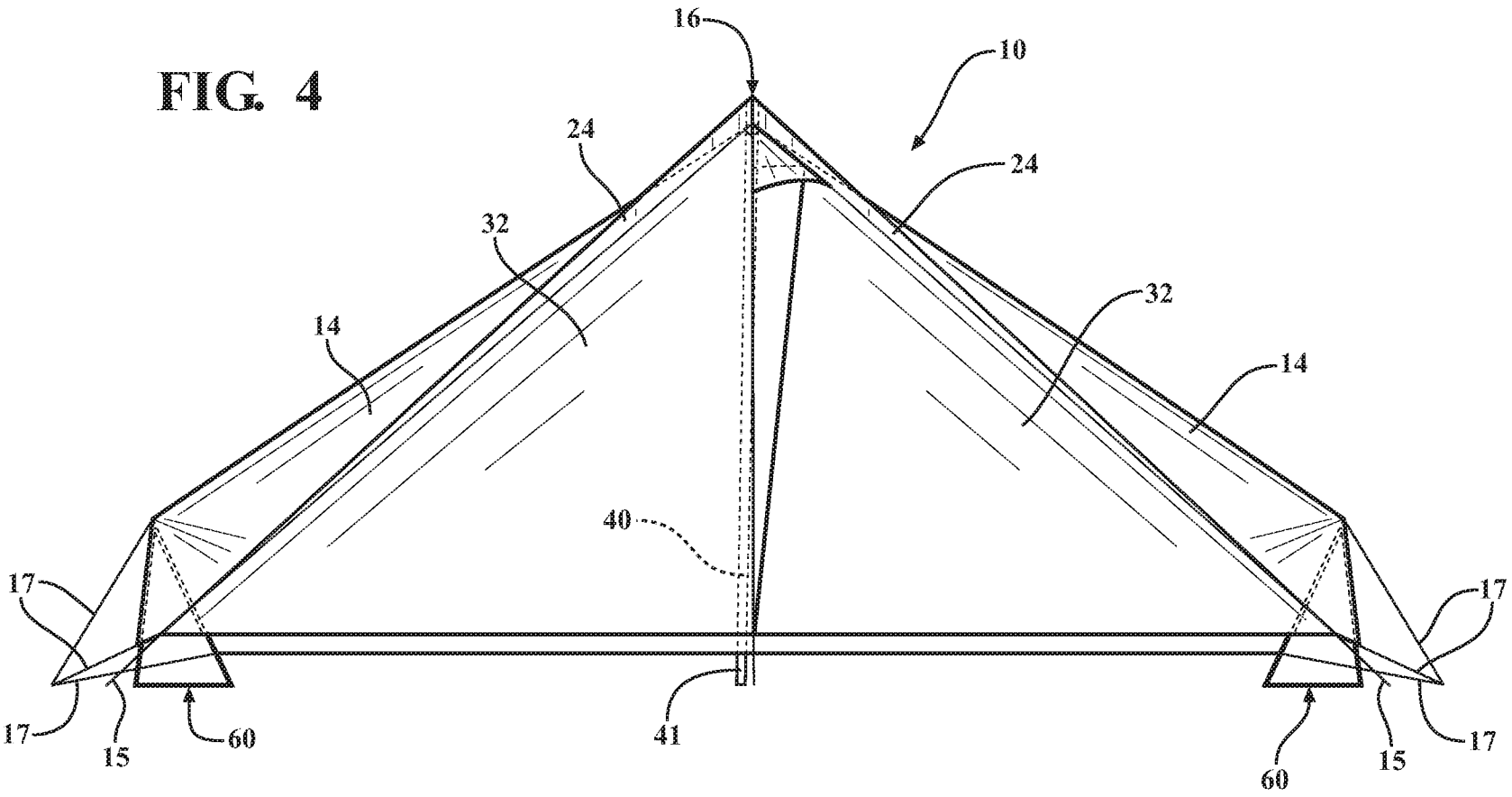
FIG. 4 is a front elevation view of the shelter of FIG. 1, with the front entrance closed.
Figure 5:
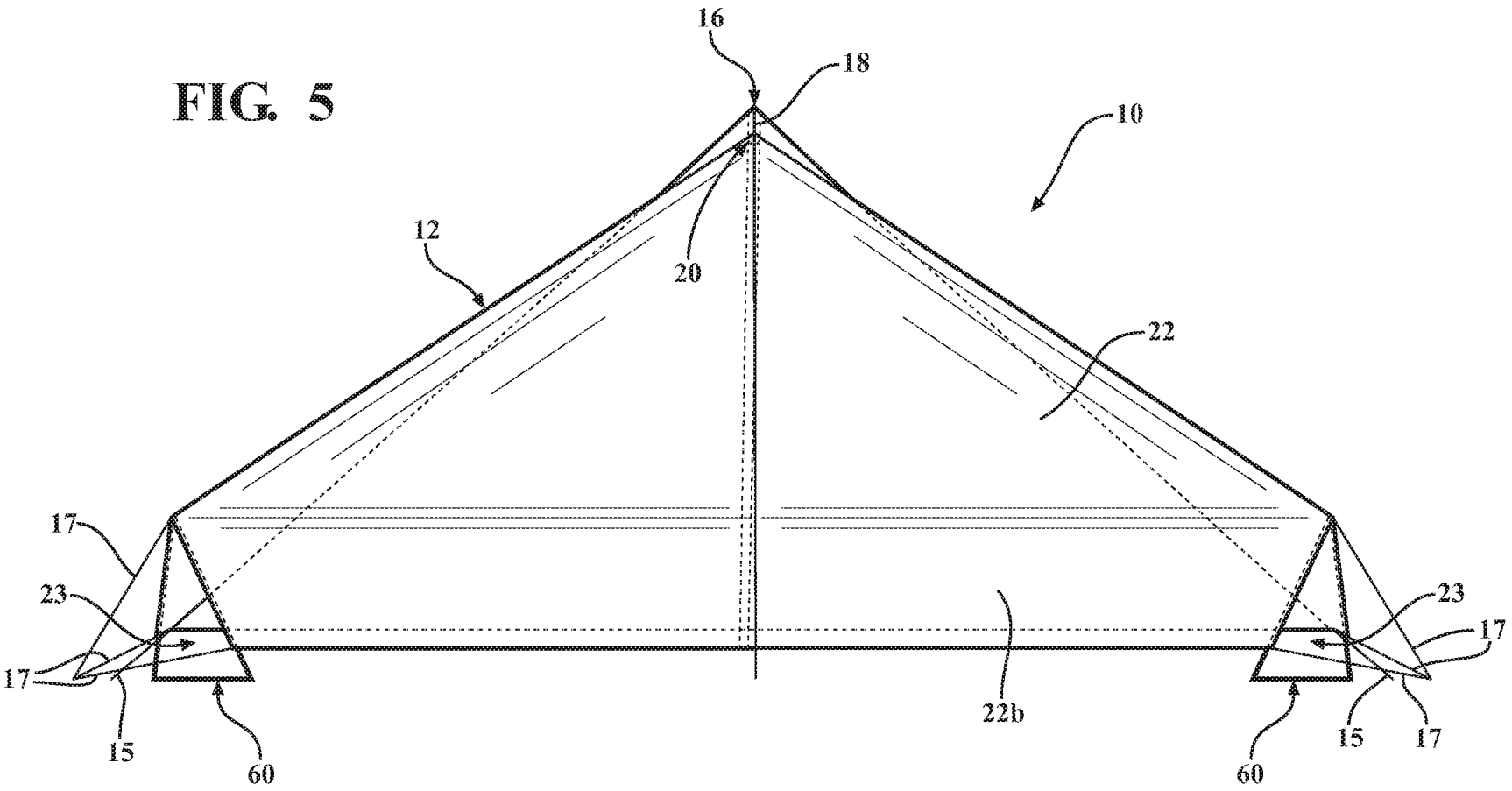
FIG. 5 is a rear elevation view of the shelter of FIG. 1.

Illustrated canopy 12 is shown with a preferred configuration for rear corners 23 comprising an upper point junction 21 of the side and rear walls 14, 22, and lower rear edges 14*e* of the side walls spaced from lower outer edges 22*e* of the rear wall. The result is each rear corner 23 comprising a triangular interruption in the lower junction of the side and rear walls 14, 22 at each rear corner of the shelter, capable of receiving a triangular strut 60 connected to and joining each spaced pair of lower rear edges 14*e* and lower outer edges 22*e* as best shown in FIG. 3A. The details of triangular strut 60 and the manner of connecting it to the fabric at rear corners 23 is described and illustrated in detail in U.S. Pat. Nos. 8,684,020 and 7,841,356 (both to Shires) incorporated herein by reference for the relevant teachings, and known and available commercially in Tarptent™ brand shelters under the name PitchLoc™. Triangular interruption Rear corner 23 may be a simple triangular interruption or opening or gap between the adjacent edges of the side and rear walls, or it may include a triangular panel of fabric (fixed, or an openable and closeable flap) as shown in the aforementioned U.S. Patents, depending on the degree of ventilation or weather resistance desired at the rear corners of the canopy.

Referring to FIG. 3A, triangular struts 60 are staked in tension to the ground at 118 via a three-point arrangement of rear guylines 17, again described and known per the above U.S. Patents and the Tarptent™ brand shelters using PitchLoc™ struts. If a separate inner tent or floor component is used under the canopy, an optional additional rear guyline 117 may extend from the stake 118 to an adjacent corner of the inner tent/floor component as shown and described in the aforementioned U.S. Patents and Tarptent™ products.

Triangular struts 60 are greatly preferred for providing extra stability and perimeter wall height at the rear of the shelter, but are not necessary. For example, simpler vertical struts may be used along vertical seam junctions of the rear and side walls, with no triangular gap or interruption between the adjacent rear and side walls. The rear corners 23 of canopy 12 may be unstructured fabric junctions of the lower edges of the side walls 14 and rear wall 22, with no struts but only guylines. Rear wall 22 may also be extended at a continuous angle similar to that of side walls 14, without the lower vertical section 22*b*, such that the junctions of the rear wall and the side walls come to a lower point similar to front corner 14*d*; this last configuration can be schematically pictured by assuming that the rear guylines 17 in the illustrated example represent fabric seams where the rear and side walls are joined.

Referring to FIGS. 1, 2 and 6, canopy 12 in a minimalist form may have a permanent front entrance opening 26, with an optional guyline 15 (FIG. 2) extending from peak 16 or front cross-strut support point 30 for extra stability in a manner generally known for half-pyramid shelters, if desired. Alternately, and preferably, canopy 12 may have front door panels 32 attached to the front edges of eave walls 24 and extending downwardly to the ground at an angle forwardly of the front cross-strut support as shown in FIGS. 3, 6 and 7. Front door panels 32 may be stored out of the way by rolling them up to the eaves and securing them with straps, cords, magnets, etc. at 37 as shown in FIG. 1, or they may be detachably connected to the eave walls. Front door panels are preferably independently opened and closed at their inner seam 32*a* junction using known securing features such as mating zippered edges or overlapping edges with ties or clips or hook-and-loop closures. When unrolled to close the front entrance opening 26 as shown in FIG. 6, door panels 32 may be staked to the ground either directly or with short guylines 15 for additional stabilizing tension on the canopy 12 in the manner of a guyline. It will be understood by those skilled in the art that seam 32*a* of the door panels can schematically represent an optional guyline extending in forward, downward tension from the cross-strut and/or peak to the ground.

It should be appreciated, however, that when the front door panels 32 are rolled up (or detached, if detachably connected to the front eaves), between canopy 12, vertical pole 40, cross-strut 50, and the staked front and rear corners 14*d*, 23 provide a static equilibrium sufficient to maintain the shape and structure of the shelter with good stability, without using a front guyline from peak 16 or pole 40 or from any other point along the front entrance 26. This allows an open-fronted shelter configuration in fair weather, without any obstruction to entry or exit through the front entrance other than vertical support pole 40.

This static equilibrium is achieved in part through the extension of cross-strut 50 forwardly of vertical pole 40 to its front cross-strut support point 30 in the forward end of the eave junction defining the front canopy ridgeline 28 back to peak 16, and the downward and rearward tension through the downwardly-narrowing eaves 24 toward staked front corners 14*d*.

Referring to FIGS. 7 and 8, canopy 12 is illustrated with an interior "nest" or separate inner tent component 70. Illustrated nest 70 comprises a floor 72 and/or an inner tent wall 74 made from ventilating mesh or solid breathable fabric or a combination thereof, with wall shapes and dimensions similar to those of canopy 12 but sized to fit thereunder with some space between them for ventilation and condensation management. Nest 70 may be permanently or detachably connected to canopy 12. In the illustrated example, nest 70 is detachably connected to canopy 12 by connecting ground level nest corners 73 to the inside of the canopy corners 14*d* and 23, for example via cords/straps 80 connected to clips on the inside of the canopy fabric and/or to the rear strut guylines in known manner. The nest peak 76 is preferably shaped to receive horizontal cross-strut 50 therethrough via suitable openings such as grommet-penetrated fabric patches 78 (FIG. 8), and to be clipped or otherwise fastened to the underside of the canopy adjacent peak 16 in known manner. Nest peak 76 may also be configured to mate with canopy peak 16 with a suitable peak reinforcement capable of accepting pole 40 inside the nest, or alternately to be clipped or otherwise secured to the interior of the canopy 12 near peak 16 peak below cross-strut 50. The upper end 42 of vertical support pole 40 may further be secured temporarily to cross-strut 50 with a connector such as a hook-and-loop strap 51, if desired; however, the grommet-and-fabric patch 78 tends to provide sufficient stabilization for cross-strut 50 when the inner nest 70 is set up so that a strap such as 51 is optional.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A lightweight, one-pole, half-pyramid type backpacking tent shelter, comprising in an erected configuration:

a fabric canopy comprising side walls, a rear wall, and front eave walls connected to the ground under tension against a vertical pole, the side walls narrowing upwardly at a converging angle to a junction defining a peak supported by the vertical pole along a vertical peak axis and further defining a short rear canopy ridgeline extending rearwardly and downwardly from the peak and terminating at a rear cross-strut support point spaced from and below the peak;

the rear wall joined to and extending between rear edges of the side walls and converging upwardly toward and terminating at the rear cross-strut support point;

the front eave walls extending from front edges of the sidewalls to define a front entrance opening defined by front edges of the front eave walls, the front eave walls comprising wider upper ends joined to define a forward canopy ridgeline extending forwardly and downwardly from the peak and terminating at a front cross-strut support point spaced from and below the peak, the front eave walls further narrowing inwardly from the front cross-strut support point toward lower front corners of the canopy at lower front corners of the side walls;

a cross-strut extending horizontally between the front and rear cross-strut support points and crossing the vertical support pole below the peak in a direction substantially perpendicular to the front entrance, respective ends of the cross-strut engaging the front and rear cross-strut support points, respectively; wherein, the lower front corners of the canopy are located forwardly of the peak and rearwardly of the front cross-strut support point, and lower rear corners of the canopy are located rearwardly of the rear cross-strut support point.

2. The shelter of claim 1, wherein upper ends of the front edges of the side walls converge at the peak, and wherein the lower front corners of the canopy extend forwardly beyond the vertical peak axis at a diverging angle from the vertical pole.

3. The shelter of claim 2, wherein the front cross-strut support point defines a forward maximum of the canopy extending beyond the lower front corners of the canopy, and wherein lower ends of the front eave walls terminate at the lower front corners of the canopy rearwardly of the forward maximum.

4. The shelter of claim 1, wherein the side walls and the rear wall are joined at the lower rear corners of the canopy by a triangular strut structure.

5. The shelter of claim 1, wherein the fabric canopy comprises a substantially non stretch fabric.

6. The shelter of claim 1, wherein the front edges of the side walls converge and terminate at the peak, and wherein the rear edges of the side walls converge and terminate at the rear cross-strut support point.

7. The shelter of claim 6, wherein the front edges of the front eave walls converge and terminate at the front cross-strut support point.

8. The shelter of claim 1, wherein the side walls and the rear wall are joined at the lower rear corners of the canopy, and further wherein the rear cross-strut support point is located forwardly of the lower rear corners of the canopy.

9. The shelter of claim 1, wherein the cross-strut extends between the front and rear cross-strut support points substantially perpendicular to the vertical pole axis.

10. The shelter of claim 1, further comprising one or more front door panels attached to the canopy at the front edges of the front eave walls.

11. The shelter of claim 10, wherein the one or more front door panels extend downwardly and forwardly of the front cross-strut support point to a tensioned connection with the ground.

12. The shelter of claim 1, wherein lower side edges of the side walls are angled upwardly from the lower rear corners of the canopy to the lower front corners of the canopy.

* * * * *